US011844979B2

(12) United States Patent
Barbera

(10) Patent No.: US 11,844,979 B2
(45) Date of Patent: Dec. 19, 2023

(54) CORE EXERCISE DEVICE

(71) Applicant: Melvin A. Barbera, Liberty Township, OH (US)

(72) Inventor: Melvin A. Barbera, Liberty Township, OH (US)

( * ) Notice: Subject to any disclaimer, the term of this patent is extended or adjusted under 35 U.S.C. 154(b) by 157 days.

(21) Appl. No.: 17/568,760

(22) Filed: Jan. 5, 2022

(65) Prior Publication Data

US 2022/0387848 A1 Dec. 8, 2022

Related U.S. Application Data

(60) Provisional application No. 63/195,737, filed on Jun. 2, 2021.

(51) Int. Cl.
*A63B 23/02* (2006.01)
*A63B 21/00* (2006.01)

(52) U.S. Cl.
CPC ..... *A63B 23/0205* (2013.01); *A63B 21/0004* (2013.01); *A63B 21/4035* (2015.10); *A63B 21/4039* (2015.10); *A63B 21/4047* (2015.10); *A63B 2208/0261* (2013.01)

(58) Field of Classification Search
CPC ..... A63B 21/0004; A63B 21/4035; A63B 21/4039; A63B 21/4047; A63B 23/0205; A63B 23/0211; A63B 23/0222; A63B 23/0227; A63B 2208/0261
See application file for complete search history.

(56) References Cited

U.S. PATENT DOCUMENTS

| | | | | |
|---|---|---|---|---|
| 8,088,052 | B1 * | 1/2012 | Sprague | A63B 26/003 482/141 |
| 8,353,808 | B1 * | 1/2013 | Barney | A63B 23/0355 482/141 |
| 9,079,072 | B2 * | 7/2015 | Agostini | A63B 21/0004 |
| 9,216,321 | B2 * | 12/2015 | Agostini | A63B 22/18 |
| 9,327,155 | B2 * | 5/2016 | Doyle | A63B 23/0355 |
| 9,539,465 | B2 * | 1/2017 | Agostini | A63B 22/203 |
| 9,878,199 | B2 * | 1/2018 | Agostini | A63B 26/003 |
| 10,279,213 | B2 * | 5/2019 | Agostini | A63B 22/203 |
| 10,507,359 | B1 * | 12/2019 | Shubin Stein | A63B 26/003 |
| 10,583,321 | B2 * | 3/2020 | Panes | A63B 21/0023 |
| 11,324,997 | B2 * | 5/2022 | Panes | A63B 21/023 |
| 2007/0298947 | A1 * | 12/2007 | Eksteen | A63B 22/20 482/141 |
| 2012/0010058 | A1 * | 1/2012 | Sprague | A63B 21/0004 482/141 |
| 2012/0252645 | A1 * | 10/2012 | Agostini | A63B 21/0004 482/132 |

(Continued)

*Primary Examiner* — Joshua Lee
(74) *Attorney, Agent, or Firm* — Frost Brown Todd LLP

(57) ABSTRACT

An exercise device includes a body engagement portion and a ground engagement portion. The body engagement portion is capable of supporting a user. The body engagement portion includes a base surface capable of supporting the user in a standard plank position. The ground engagement portion includes an arched contact surface that allows the user to rotate between a first side plank position, the standard plank position, and a second side plank position relative to a support surface while the arched contact surface remains in contact with the support surface and the body engagement portion supports the user.

20 Claims, 16 Drawing Sheets

(56) References Cited

U.S. PATENT DOCUMENTS

| | | | | |
|---|---|---|---|---|
| 2014/0011649 | A1* | 1/2014 | Carney | A63B 22/18 482/142 |
| 2015/0238795 | A1* | 8/2015 | Domesick | A63B 21/0023 482/142 |

* cited by examiner

CORE EXERCISE DEVICE

PRIORITY

This Application claims priority to U.S. Provisional Application 63/195,737, titled "Core Exercise Device," filed on Jun. 2, 2021.

BACKGROUND

Core strength and conditioning of the abs, back, and glutes may be desired for various reasons, such as good posture, optimal physical performance, etc. Planks are an isometric core conditioning exercise that can be done to improve core strength and conditioning. A standard plank is an isometric exercise done by holding the body in a straight line from feet to head with the upper body elevated while supporting a substantial portion of bodyweight on the elbows or hands in a face-down position. Similarly, a side plank is done by holding the body in a straight line from feet to head with the upper body elevated; but is performed by supporting a substantial portion of bodyweight on one elbow or hand while facing a direction parallel to the floor. Generally, standard and side planks are done by statically holding the above-described positions for a period of time.

A variation of a plank involves placing the hands or elbows on an unstable surface, like a half sphere balance ball, in order to add a balancing component to increase the effort during a plank. Other devices have been used to add a balancing component to the plank position.

While a variety of exercise devices for the core have been made and used, it is believed that no one prior to the inventor has made or used an invention as described herein.

BRIEF DESCRIPTION OF THE DRAWINGS

While the specification concludes with claims which particularly point out and distinctly claim the invention, it is believed the present invention will be better understood from the following description of certain examples taken in conjunction with the accompanying drawings, in which like reference numerals identify the same elements and in which:

FIG. 6 depicts a perspective view of the floor engagement portion of the core exercise device of FIG. 1;

Figure 1:
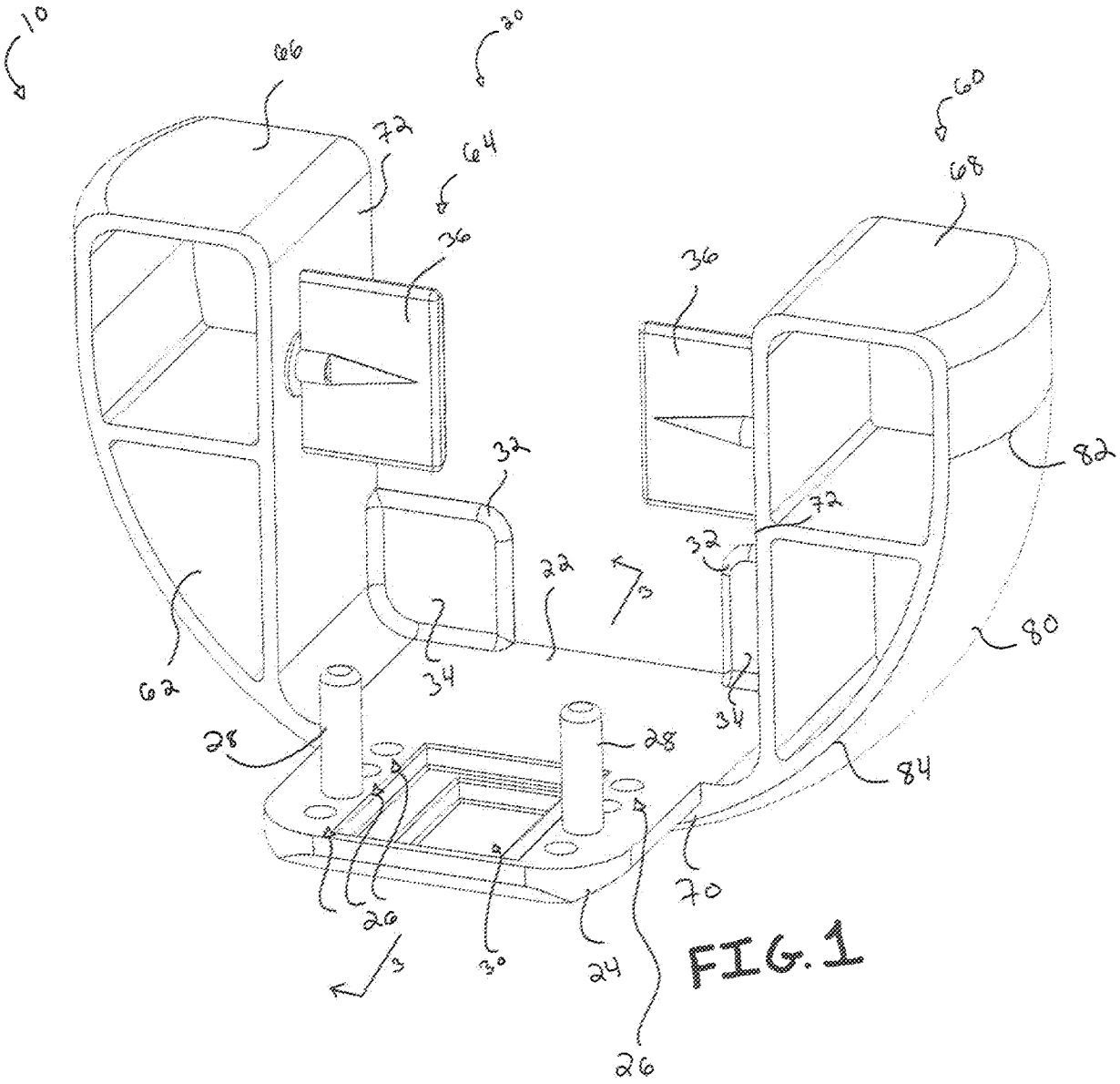
FIG. 1 depicts a perspective view of an exemplary core exercise device including a body engagement portion and a floor engagement portion.

The drawings are not intended to be limiting in any way, and it is contemplated that various embodiments of the invention may be carried out in a variety of other ways, including those not necessarily depicted in the drawings. The accompanying drawings incorporated in and forming a part of the specification illustrate several aspects of the present invention, and together with the description serve to explain the principles of the invention; it being understood, however, that this invention is not limited to the precise arrangements shown.

DETAILED DESCRIPTION

The following description of certain examples of the invention should not be used to limit the scope of the present invention. Other examples, features, aspects, embodiments, and advantages of the invention will become apparent to those skilled in the art from the following description, which is by way of illustration, one of the best modes contemplated for carrying out the invention. As will be realized, the invention is capable of other different and obvious aspects, all without departing from the invention. Accordingly, the drawings and descriptions should be regarded as illustrative in nature and not restrictive.

I. Exemplary Core Exercise Device

As mentioned above, the standard plank involves a person supporting a substantial portion of their bodyweight in a face-down position (i.e., facing in a direction perpendicular with the floor), while the side plank involves a person supporting a substantial portion of their bodyweight while facing a direction parallel to the floor. In some instances, it may be desirable for a person to perform an isometric plank at rotational positions between, and including, the standard plank and the side plank. This may allow a person to exercise and condition certain portions of their core to a greater degree as compared to standard and side planks. Therefore, it may be desirable to have a device that provides the option of unlimited isometric positions; including the standard frontal plank, each of the full side planks, and a plank at any angle in-between. Such a device may allow a person to rotate into a desired angle and hold that plank position for a suitable period of time. This may also add a balancing component to achieving such isometric positions.

As also mentioned above, there are devices used to add a balancing component while a person holds the plank position, thereby allowing that person to slightly pivot about their long axis while maintaining the isometric, standard plank position. In such balancing exercises, the person's weight may shift laterally relative to the portion of the device in contact with the ground, thereby adding the balancing component of the exercise. In some instances, rather than merely providing a balancing component with a lateral shift/tilting in weight as described above, it may be desirable to provide a piece of exercise equipment that provides a person with the ability of isotonic dynamic planking by continuously rotating from one side plank position to the other side plank position (or between any other desirable planking positions as would be apparent to one skilled in the art in view of the teachings herein).

FIGS. 1-5 shows an exemplary core exercise device (10). Core exercise device (10) includes a body engagement portion (20) and a floor engagement portion (60). Core exercise device (10) may be formed of any suitable material as would be apparent to one skilled in the art in view of the teachings herein. For example, core exercise device (10) may be formed of wood, metal, plastic, elastomeric material, inflatable material, or a combination thereof. In some instances, core exercise device (10) may be a single unit, such that no parts are configured to selectively decouple with each other.

As will be described in greater detail below, core exercise device (10) is configured to allow a person to perform an isometric standard plank (see FIG. 13), either isometric side plank (see FIGS. 14-15), or any other suitable isometric plank position between either side plank as would be apparent to one skilled in the art in view of the teachings herein. Additionally, as will be described in greater detail below, core exercise device (10) is configured to provide isotonic dynamic planking by allowing a person to continuously rotate from one side plank position to the other side plank position (or from any suitable planking position to any other suitable planking position as would be apparent to one skilled in the art in view of the teachings herein).

A. Exemplary Body Engagement Portion

Body engagement portion (20) includes a base surface (22), a forearm support extension (24), two adjustable grips (28), two elbow pads (32) extending laterally inward from a respective interior surface (72), and two shoulder pads (36) extending laterally inward from a respective interior surface (72). As will be described in greater detail below, a person may engage suitable portions of body engagement portion (20) such that (A) the person may achieve the anatomical position relative to device (10) associated with a standard plank (e.g., see FIG. 16), and (B) the person may suitably control device (10) in accordance with the teachings herein.

Figure 16:
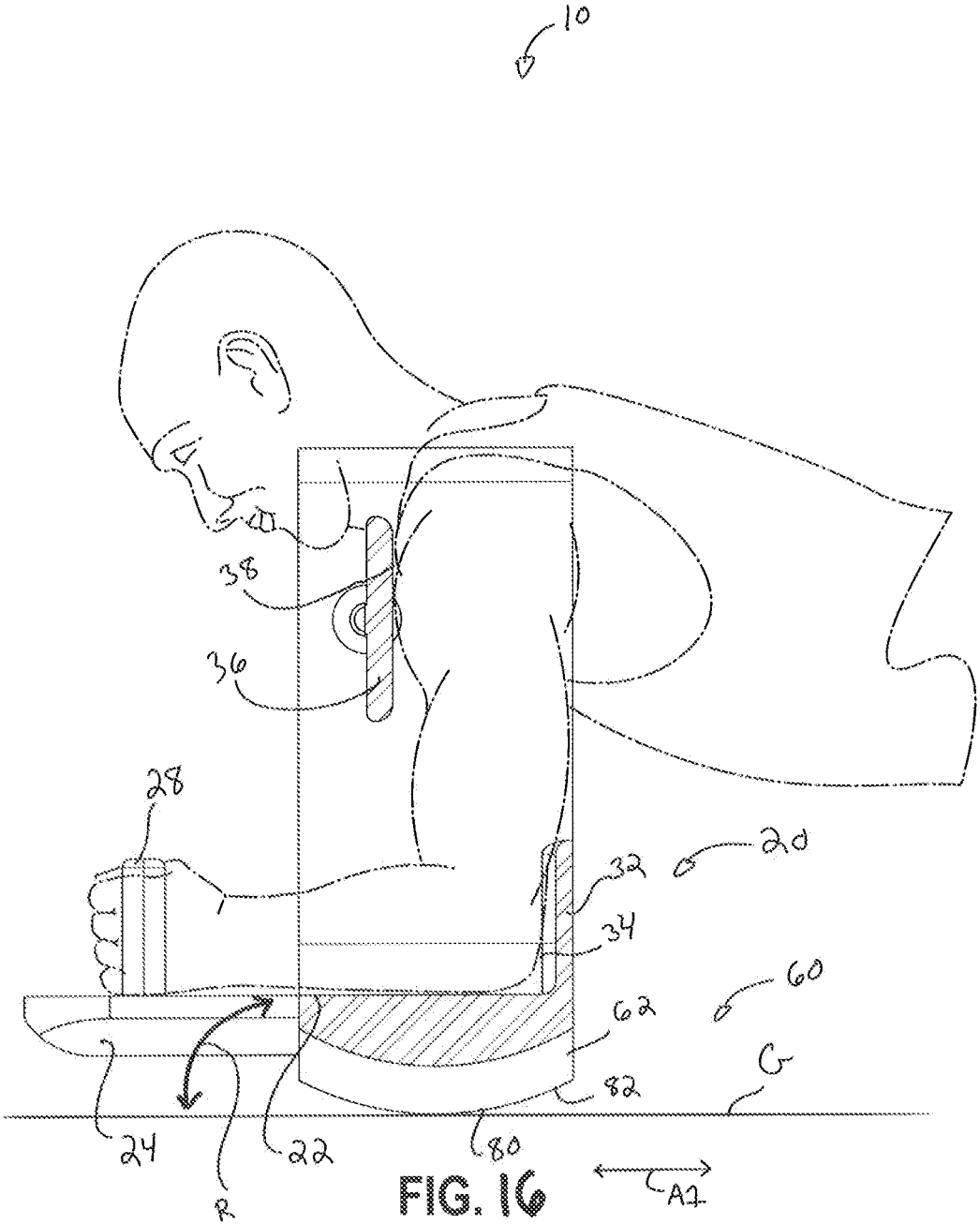
FIG. 16 depicts a cross-sectional view of the user of FIG. 13 engaged with the core exercise device of FIG. 1 in the standard plank position, taken along line 16-16 of FIG. 13.

As best shown in FIG. 16, base surface (22) is dimensioned such that a person may rest a portion of their forearms closest to their elbows on base surface (22), while they may rest the portion of their forearms closest to their hand on forearm support extension (24). Therefore, base surface (22) and forearm support extension (24) are configured to provide a surface for a person to rest their forearms while suitably engaging device (10). In other words, a person may support a substantial portion of bodyweight on their elbows/forearms by placing their elbows and forearms on base surface (22) and forearm support extension (24).

Figure 11:
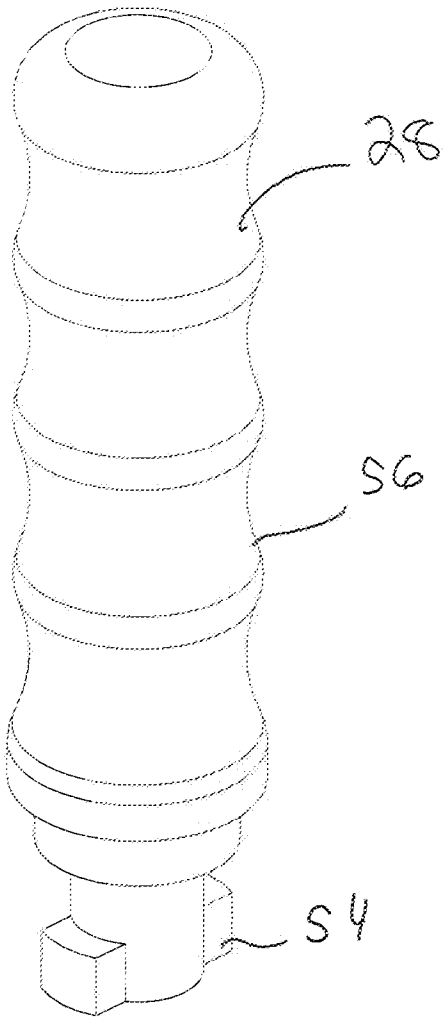
FIG. 11 depicts a perspective view of an exemplary adjustable grip of the body engagement portion of FIG. 1.

Adjustable grips (28) extend upwardly from forearm support extension (24) in order to provide an object for a person to grasp with their hands while using device (10). Therefore, a person may control forearm support extension (24) via grips (28), while in the position shown in FIG. 16, to further control device (10) during exemplary use in accordance with the teachings herein. In some instances, as shown in FIG. 11, grips (28) include an undulating surface (56) to promote easier gripping by individual fingers.

Elbow pads (32) each include an elbow contact surface (34); while shoulder pads (36) each include a shoulder contact surface (38). Elbow contact surfaces (34) and shoulder contact surfaces (38) face each other in the longitudinal direction (A1). As best shown in FIG. 16, a person may place their upper arms between respective surfaces (34, 38) such that elbows abut against elbow contact surface (34) while shoulders abut against shoulder contact surface (38). The gap between respective pads (32, 36) in the longitudinal direction (A1) may be suitable to allow a person to achieve the standard planking position shown in FIG. 16. Contact between shoulders and shoulder pads (36) and contact between elbows and elbow pads (32) may allow a person to effectively control and stabilize the positioning of device (10) during exemplary use in accordance with the description herein. Further, a person may pull on adjustable grips (28) to further promote contact between shoulders and shoulder pads (36) in order to allow a person to control and stabilize the position of device (10) in accordance with the teachings herein. In other words, pulling on grips (28) may promote firm contact on surfaces (34, 38) for optimal control of device (10).

In some instances, it may be desirable to adjust the position of the various features of body engagement portion (20) relative to other features of device (10). For instance, various users of device (10) may have different anatomical dimensions. As one example, the length of various user's forearms may deviate such that the length between adjustable grips (28) and elbow contact surfaces (34) in the longitudinal direction (A1) may need adjustments for various users to properly engage device (10) while forming the standard plank position. As another example, the dimensions of users' upper arms may deviate in length and thickness such that the distance between elbow contact surfaces (34) and shoulder contact surfaces (38) in the vertical and the longitudinal direction may need adjustment for different users to properly engage device (10) while forming the standard plank position.

Figure 7:
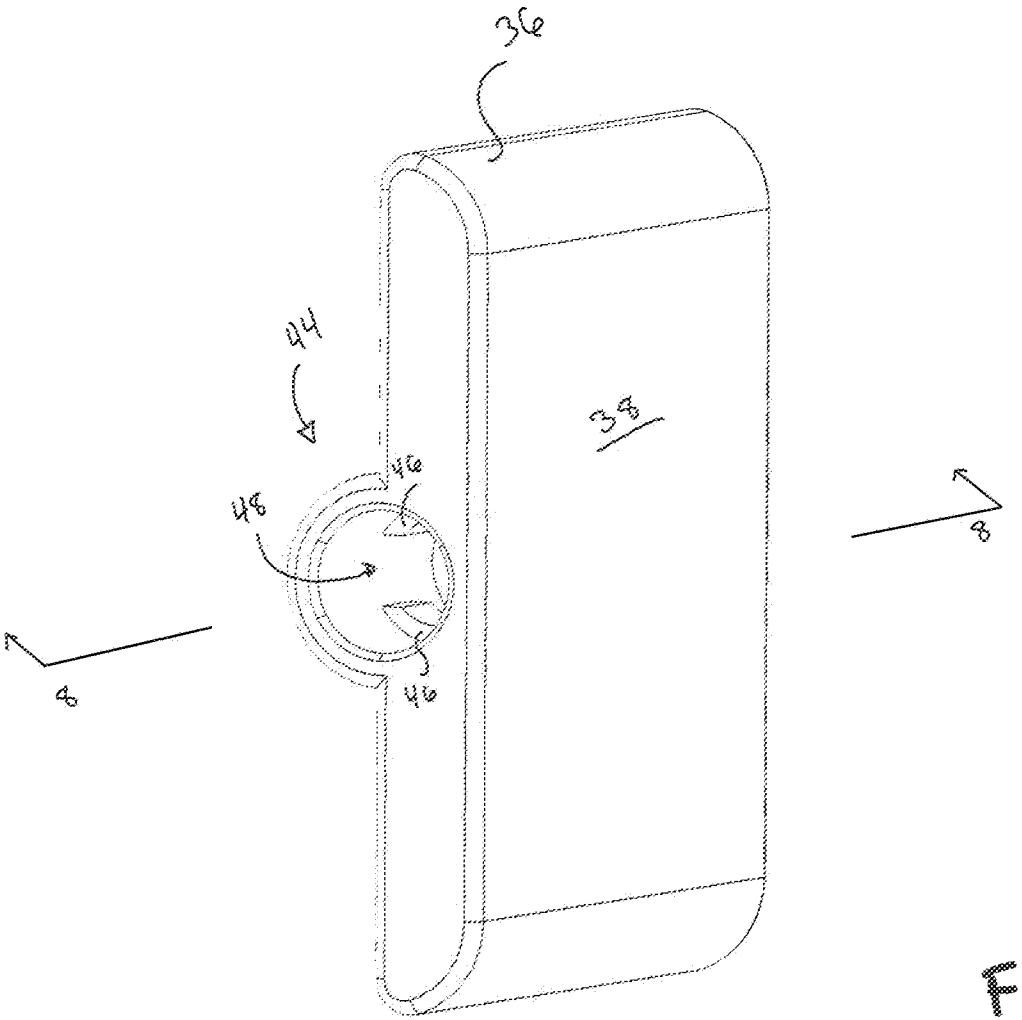
FIG. 7 depicts a perspective view of an exemplary shoulder pad of the body engagement portion of FIG. 1.
Figure 8:
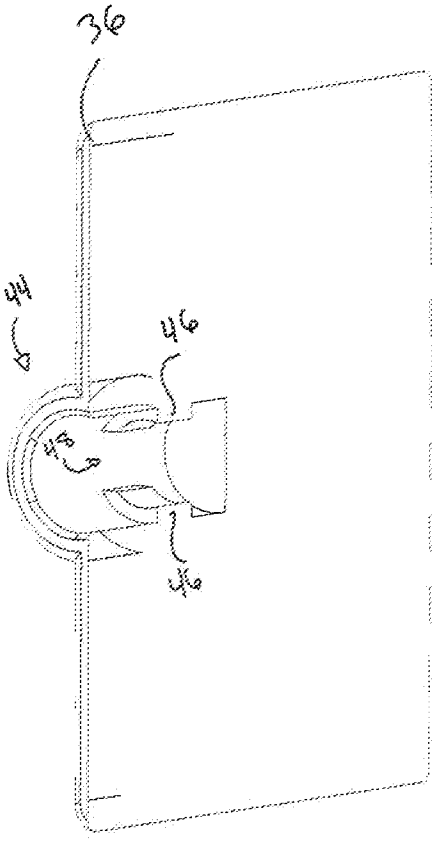
FIG. 8 depicts a sectional view of the shoulder pad of FIG. 7, taken along line 8-8 of FIG. 7.
Figure 9:
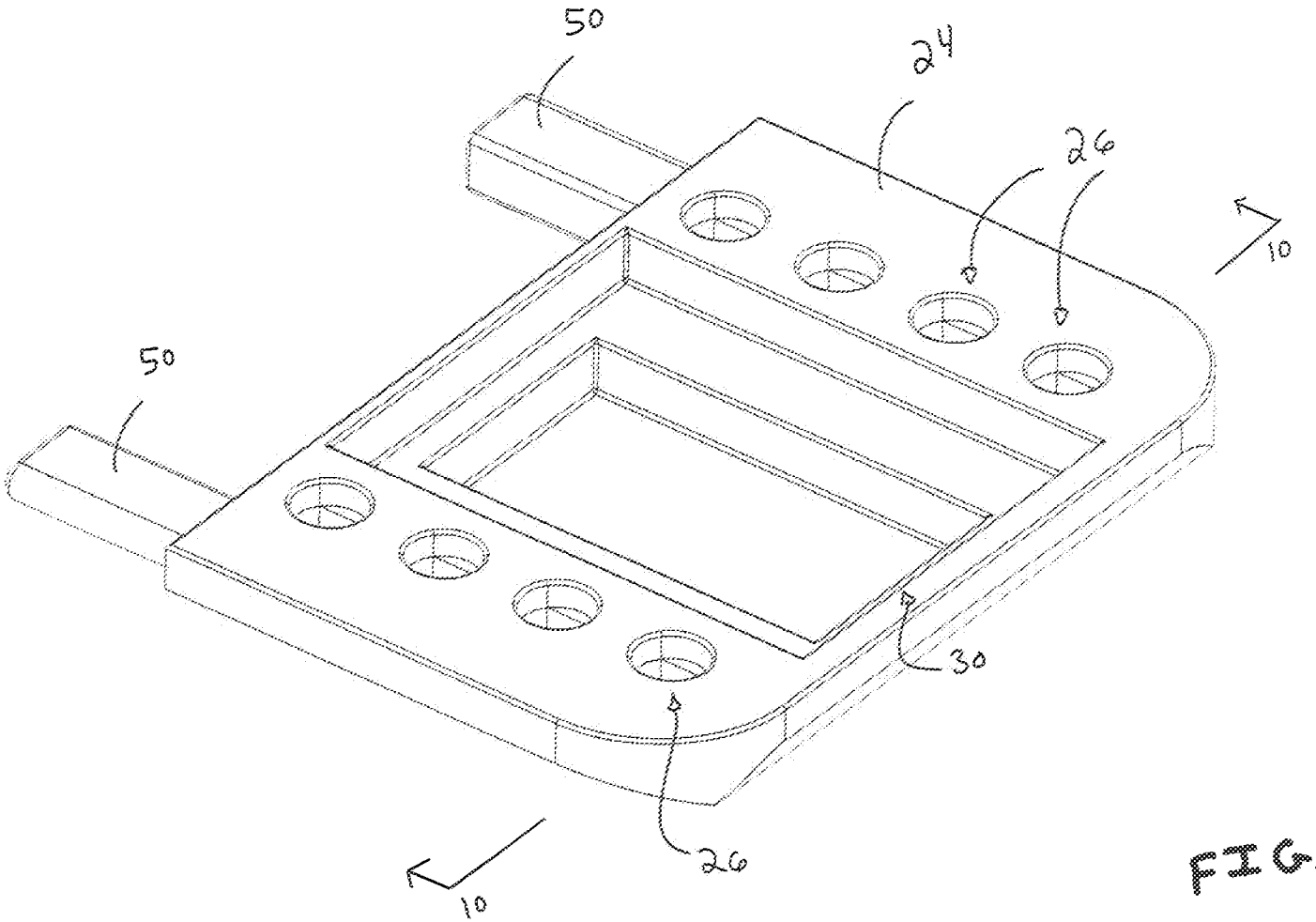

FIGS. 6-11 show various features that may be implemented into device (10) in order to accommodate various users with different body types, therefore allowing customizability for users to suitably utilize device (10) in accordance with the description herein. FIG. 6 shows an exemplary shoulder pad coupling (40) located on interior surfaces (72) of floor engagement portion (60), while FIGS. 7 and 8 show an exemplary shoulder pad (36) configured to selectively couple with shoulder pad coupling (40) while promoting comfortable contact with the shoulder during movements in accordance with the teachings herein.

In the current example, shoulder pad coupling (40) extends laterally inward and includes a keyed feature (42). Keyed feature (42) is dimensioned to be selectively inserted within an opening (44) defined by shoulder pad (36). In particular, a user may align keyed feature (42) with a respective keyed pathway (48) defined by projections (46) extending within opening (44). Once aligned, the user may then insert shoulder pad (36) toward the respective interior surface (72) such that keyed feature (42) extends within opening (44) past projections (46). Next, the user may rotate shoulder pad (36) such that (A) shoulder contact surface (38) faces at least partially toward elbow contact surface (34), and (B) contact between keyed feature (42) and projections (46) inhibits shoulder pad (36) from disassociating with shoulder pad coupling (40). In some instances, shoulder pad (36) may be configured to rotate about shoulder pad coupling (40) along an axis that is parallel with lateral direction (A2). In some aspects of the disclosure, shoulder pads (36) are not configured to rotate (i.e., non-rotational) during exemplary use in accordance with the description herein. In some aspects of the disclosure, shoulder pads (36) are configured to remain firmly attached to surface (72) during exemplary use in accordance with the description herein. In some aspects of the disclosure, the position of shoulder pad (36) on surface (72) may be selectively adjustable while remaining non-rotational during exemplary use in accordance with the description herein.

While keyed features (42) and projections (46) are used in the current example to selectively couple shoulder pad (36) with interior surface (72) of floor engagement portions (60), any other suitable structures may be used in order to allow shoulder pads (36) to selectively couple with floor engagement portion (60) as would be apparent to one skilled in the art in view of the teachings herein. For example, shoulder pad (36) may include a dovetail projection while interior surfaces (72) may define a slot dimensioned to receive the dovetail projection.

Allowing for shoulder pads (36) to selectively couple with floor engagement portion (60) may also allow a user to facilitate adjustments for a specific size of a user.

For example, device (10) may come with multiple size shoulder pads (36) dimensioned with different heights and thicknesses. Therefore, a user may select a specific pair of shoulder pads (36) that allow for the specific user to suitably engage shoulder pads (36) and elbow pads (32), thereby allowing the user to suitably control device (10) while maintaining a proper plank position in accordance with the teachings herein.

In some instances, shoulder pads (36) may have additional pads that may be selectively attached to shoulder contact surface (38), thereby allowing a user to change the longitudinal distance between shoulder contact surface (38) and elbow contact surface (34). The additional pads may selectively attach to shoulder contact surface (38) of shoulder pad (36) via any suitable manner as would be apparent to one skilled in the art in view of the teachings herein. For instance, additional pads may include elastic bands that may wrap around the first shoulder pad (36) in order to couple together. Alternatively, additional pads may selectively couple with first shoulder pad (36) via a hook and loop fastener system. Of course, these additional pads may be configured to couple with elbow pads (32) in alternative to, or in addition to, coupling with shoulder pads (36). Additional pads may also be configured to attach to base surface (22), forearm support extension (24), and/or interior surfaces (72) to adjust for the specific size of a user. In some aspects of the disclosure, elbow pads (32) may also be adjustable in a similar fashion to shoulder pads (36) described herein. In some aspects of the disclosure, elbow pads (32) may be adjustable relative to interior surfaces (72) and/or base surface (22) via any suitable means as would be apparent to one skilled in the art in view of the teachings herein. For example, elbow pads (32) may be selectively extendable and retractable out of and into curved body (62). Any suitable means of coupling elbow pads (32) with curved body (62) may be utilized as would be apparent to one skilled in the art in view of the teachings herein.

Figure 9:
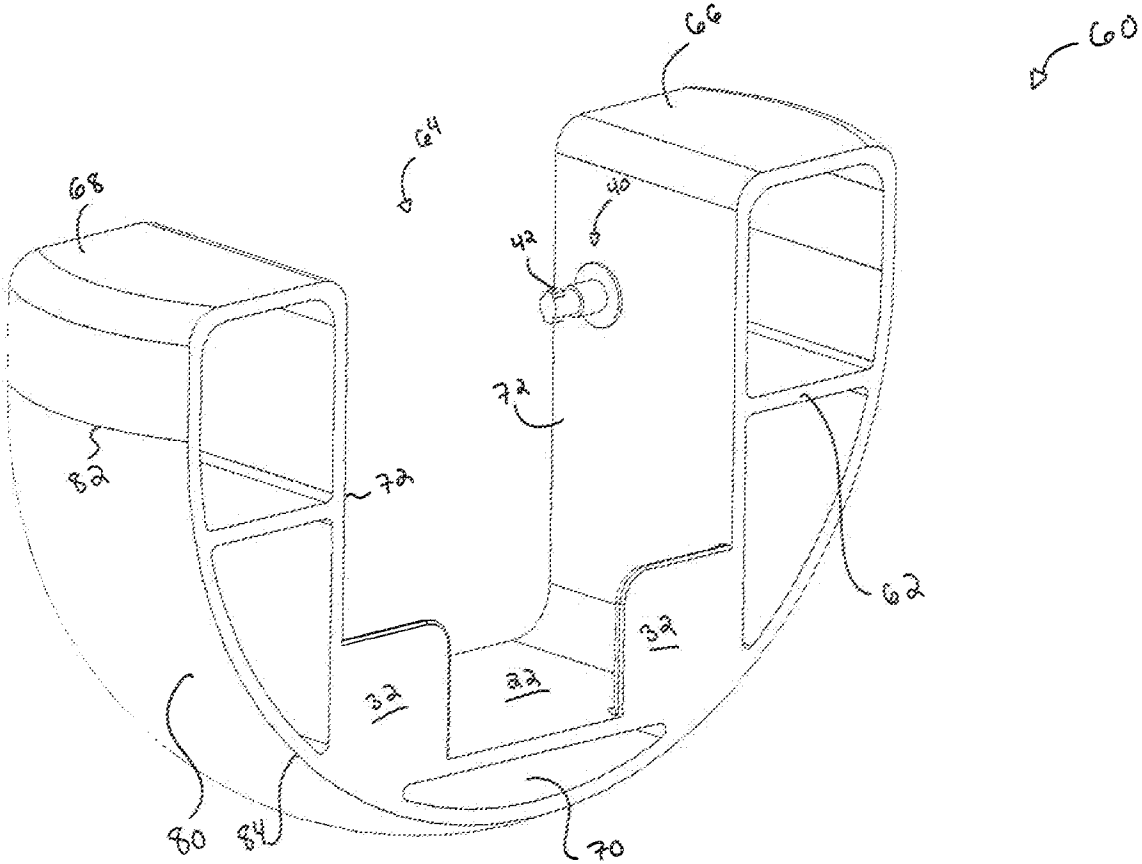
FIG. 9 depicts a perspective view of an exemplary forearm support extension of the body engagement portion of FIG. 1.
Figure 10:
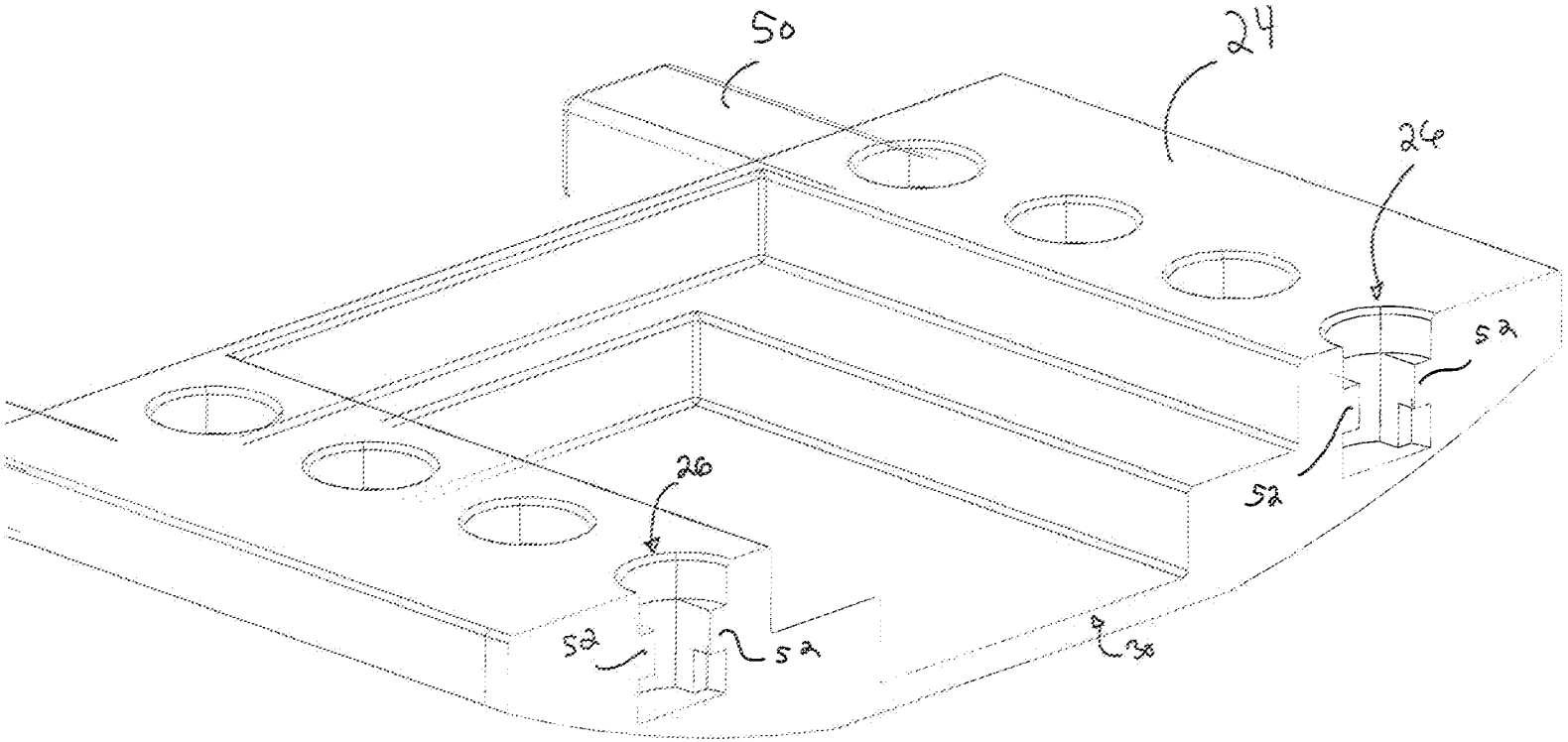
FIG. 10 depicts a sectional view of the forearm support extension of FIG. 9, taken along line 10-10 of FIG. 9.

FIGS. 9-10 show an exemplary forearm support extension (24). Forearm support extension (24) includes a device receiving pocket (30). Device receiving pocket (30) may be configured to receive a cell phone, tablet, television, book, or other device as would be apparent to one skilled in the art in view of the teachings herein. Therefore, in some instances, a user may view the device contained in pocket (30) while exercising on device (10) itself. In some instances, when an electrical device is housed within pocket (30), such an electrical device may include an application that is programed to interact with the motion of the present device (10), thereby adding variety and additional challenges to an exercise routine. While device receiving pocket (30) is used in the current aspect of the disclosure to receive a suitable electronic device, any other suitable means may be used to secure electronic device to forearm support extension (24) as would be apparent to one skilled in the art in view of the teachings herein. For example, stretchable silicone straps configured to stretch and engage the corners of any sized device may be used to secure electronic devices to forearm support extension (24). Such stretchable silicone straps may be attached to a rotating base that allows for electronic device to be adjusted between portrait and landscape viewing.

Forearm support extension (24) may be configured to (A) selectively attach to floor engagement portion (60), (B) adjust relative to floor engagement portion (60) along the longitudinal direction (A1) and lateral direction (A2), and (C) selectively couple with adjustable grips (28) along the various locations of forearm support extension (24). In the current example, forearm support extension (24) includes a pair of coupling posts (50). Coupling posts (50) may be inserted within openings defined by a bottom portion (70) of floor engagement portion (60) in order to selectively couple forearm support extension (24) with bottom portion (70). Coupling posts (50) may selectively attach with bottom portion (70) utilizing any suitable means as would be apparent to one skilled in the art in view of the teachings herein. While in the current example, coupling posts (50) are used, any other suitable coupling features may be implemented as would be apparent to one skilled in the art in view of the teachings herein.

In some instances, forearm support extension (24) may be adjustable in length along the longitudinal direction (A1) or the lateral direction (A2) relative to bottom portion (70). In some instances, various forearm support extensions (24) having different lengths, widths, and/or heights may be used and selectively attached to bottom portion (70), according to the needs of the specific user. In some instances, coupling posts (50) may be omitted entirely such that forearm support extension (24) is integrated with bottom portion (70) of floor engagement portion. In some aspects of the disclosure, forearm support extension (24) may be pivotally attached to floor engagement portion (60) via hinge such that forearm support extension (24) may be folded-up for storage and/or locked into place during exemplary use. Forearm support extension (24) may be pivotally attached to floor engagement portion (60) via any suitable means as would be apparent to one skilled in the art in view of the teachings herein.

As best shown in FIG. 10, forearm support extension (24) defines two longitudinal arrays of grip receiving openings (26). As best seen in FIG. 11, adjustable grips (28) include a keyed feature (54). Adjustable grips (28) may selectively couple with forearm support extension (24) via grip receiving openings (26) in similar fashion to shoulder pad coupling (40) and shoulder pads (36) described above. Therefore, keyed feature (54) is dimensioned to be selectively inserted within an opening (26) defined by forearm support extension (24). In particular, a user may align keyed feature (54) with a respective keyed pathway defined by projections (52) extending within opening (26). Once aligned, the user may then insert keyed feature (54) further within opening (26) such that keyed feature (54) extends past projections (52). Next, the user may rotate grip (28) such that contact between keyed feature (54) and projections (52) inhibits grip (28) from disassociating with forearm support extension (24).

Since grips (28) may selectively attach to forearm support extension (24) at various locations along the longitudinal direction (A1), users may customize the length between grips (28) and elbow pad (32) to accommodate for their specific forearm length, thereby allowing the user to use device (10) in accordance with the description herein.

It should be understood, in similar fashion to keyed feature (42) and projections (46) described above, that any other suitable structures may be used in order to allow grips (28) to selectively couple with forearm support extension (24) as would be apparent to one skilled in the art in view of the teachings herein. As one example, grips (28) and openings (26) may be configured to couple with each other via a threaded screw-in assembly. In some aspects of the disclosure, grips (28) may be slidably coupled to elongated slots defined by forearm support extension (24), instead of using a plurality of openings (26) in conjunction with keyed feature (54). Therefore, a user may simply slide grips (28) along a path defined by slots in order to suitably locate grips (28) on forearm support extension (24). In such aspects, grips (28) may be slidably attached to respective slots via a circular dovetail extension and complementary slot, thereby enabling grips (28) to rotate about their own axis without dissociating from forearm support extension (24). In some aspects of the disclosure, grips (28) may be equipped with wired and/or wireless connectivity in order to establish electrical communication with electronic devices secured to forearm support extension (24). Grips (28) may include various control features to thereby provide additional control over interactive software on the electronic devices. Such control features may include buttons, joy-stick capabilities, capacitive touch sensors, or any other suitable control features as would be apparent to one skilled in the art in view of the teachings herein.

In some aspects of the disclosure, a distal end of forearm support extension (24) may be modified to be grasped by a user during exemplary use in accordance with the description herein such that grips (28) are unnecessary. In such aspects of the disclosure, the distal end of forearm support extension (24) may include undulating features to further promote grasping the distal end of forearm support extension (24). In some aspects of the disclosure, a laterally extending grasping bar may extend from forearm support extension (24); which may also be selectively adjustable relative to forearm support extension (24). Any suitable structures may be incorporated to promote grasping of device (10) as would be apparent to one skilled in the art in view of the teachings herein. Of course, in some aspects of the disclosure, grips (28) and/or alternative grasping structures may be entirely omitted.

In some instances, body engagement potion (20) may have a support element to help support the back of the user. In some instances, body engagement portion (20) may be equal to, or wider than the minimum width needed for comfortable support of elbows, arms, and shoulders.

In some instances, pads (32, 36) and/or surfaces (22, 72) may be inflatable. In some instances, pads (32, 36) and/or surfaces (22, 72) may be inflatable to be adjusted to fit difference sized users.

In some instances, device (10) may include elbow, arm, and shoulder restraints rather than just surfaces (22, 34, 38, 72). In such instances, sleeves, straps, custom fit molded supports, other support pad arrangement, inflatable restraints, and the like may be used.

In some instances, no elbow, arm, and/or shoulder restraints may be needed in examples where comfort, balance, and a snug fit provide sufficient control of device (10), such as when, but not limited to, device (10) is an inflatable unit.

In some instances, all or various features of body engagement portion (20) may be inflatable such that inflation would provide adjustment of body size fitting.

Figure 13:
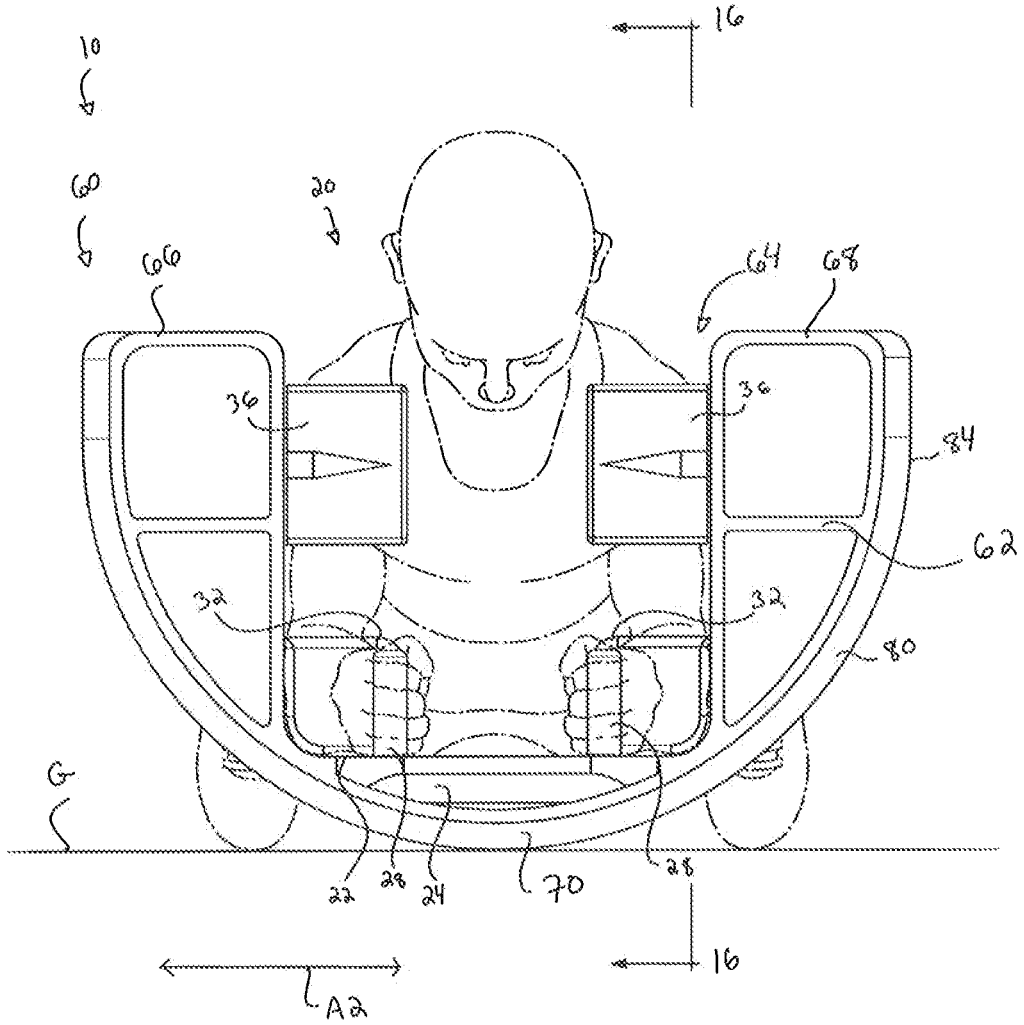
FIG. 13 depicts a front elevational view of a user engaged with the core exercise device of FIG. 1 in a standard plank position.
Figure 14:
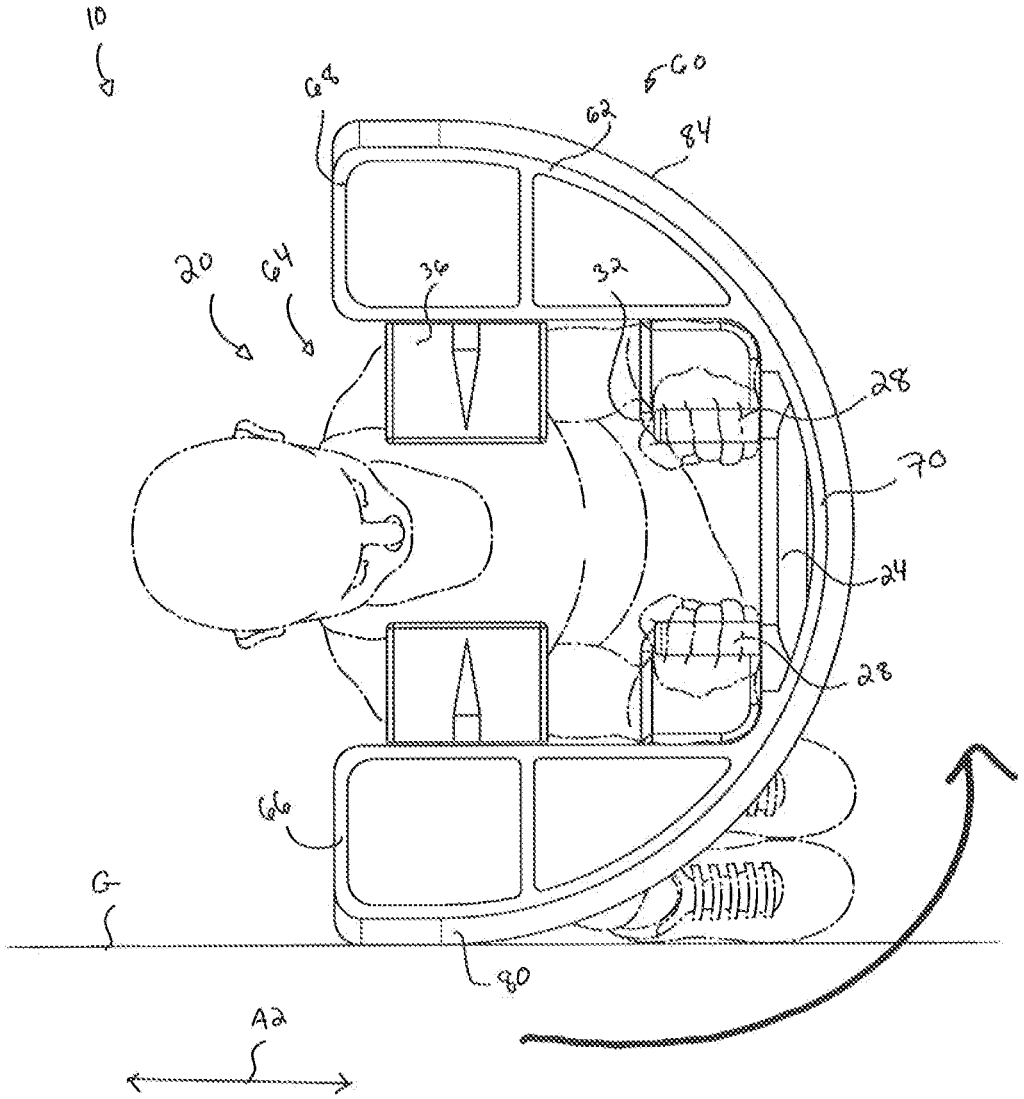
FIG. 14 depicts a front elevational view of the user of FIG. 13 engaged with the core exercise device of FIG. 1, where the user rotates with the core exercise device from the standard plank position into a right-side plank position.
Figure 15:
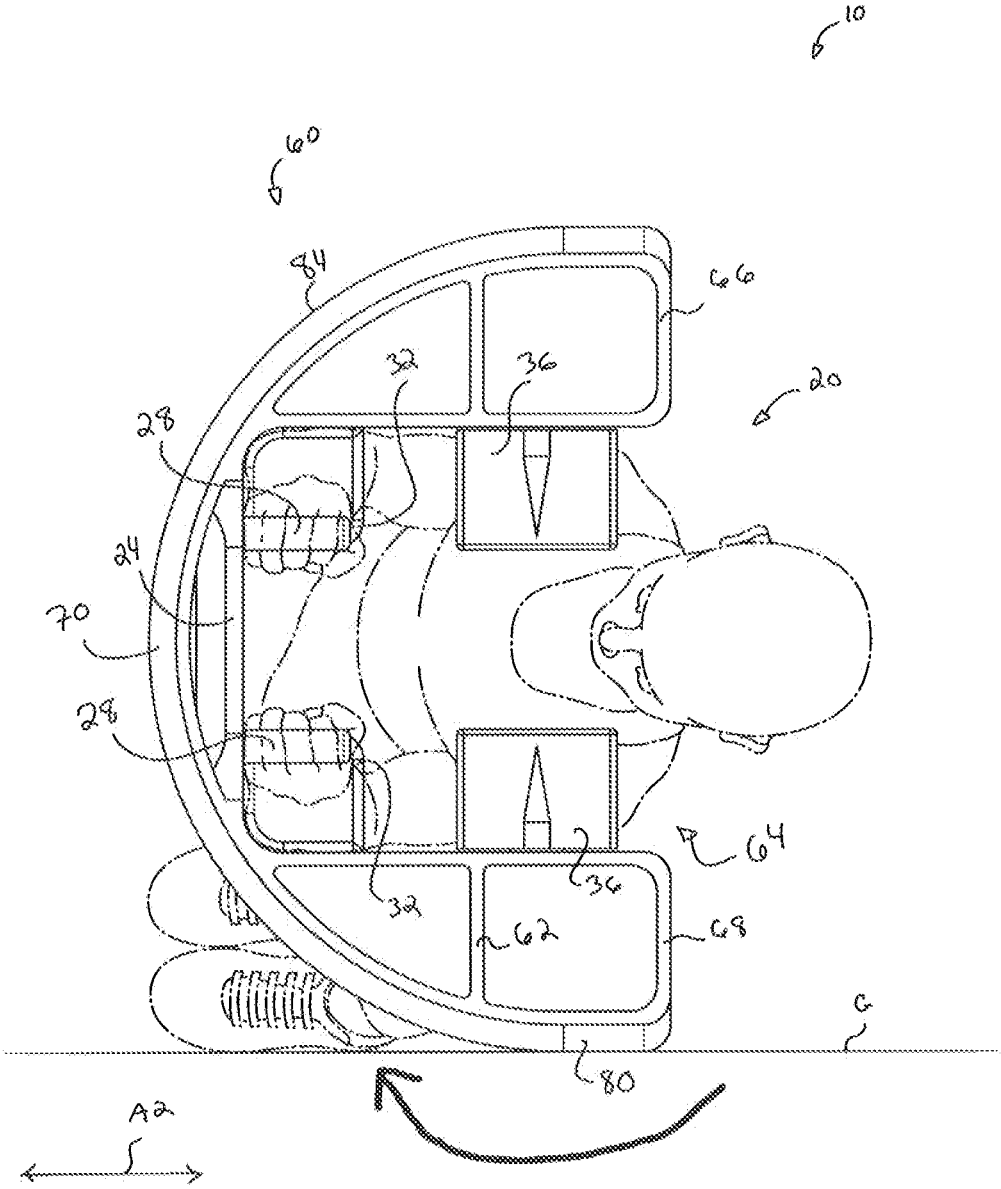
FIG. 15 depicts a front elevational view of the user of FIG. 13 engaged with the core exercise device of FIG. 1, where the user rotates with the core exercise device from the right-side plank position into a left-side plank position.

In some instances, body engagement portion (20) may have adjustments designed to keep the user's body at the center of rotation of device (10) (e.g., the axis which device (10) rotates as seen from the view in FIGS. 13-15).

B. Exemplary Floor Engagement Portion

As described above, body engagement portion (20) allows a user to suitably control device (10) while achieving the anatomical positioning of the standard plank. As will also be described in greater detail below, floor engagement portion (60) is configured to allow a user to engage in various suitable isometric plank positions between either side plank, while also allowing a person to continuously rotate from one side plank position to the other side plank position in an isotonic fashion (or from any other two desirable plank positions as would be apparent to one skilled in the art in view of the teachings herein).

Figure 2:
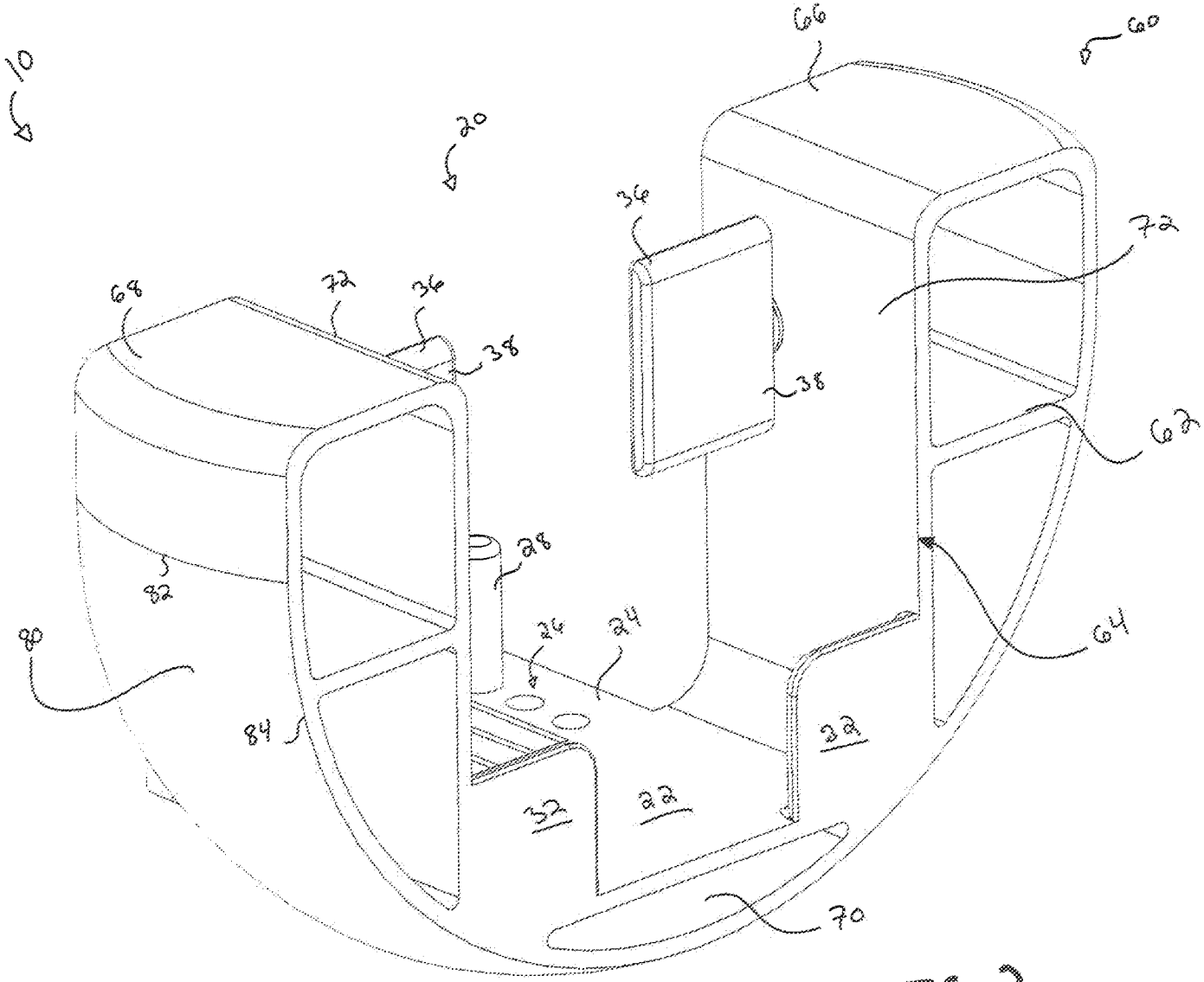
FIG. 2 depicts another perspective view of the core exercise device of FIG. 1.

As best shown in FIGS. 1-2, floor engagement portion (60) includes a curved body (62). Curved body (62) includes a central, bottom portion (70), a right-side portion (66), and a left-side portion (68). Curved body (62) allows for a user to utilize their core in order to transition between the various plank positions discussed herein. Curved body (62) defines a general U-shaped opening (64) dimensioned to receive a portion of a person's upper body. In particular, U-shaped opening (64) is dimensioned to receive a person's upper body such that the person may control device (10) via body engagement portion (20) in accordance with the description herein.

Right-side portion (66) and left-side portion (68) each include a respective interior surface (72). As best shown in FIGS. 14-15, interior surfaces (72) are configured to abut against an upper arm of a person in order to support the person in a side plank position (or partially support the person in a partial side plank position between the positions shown in FIG. 14-15).

Curved body (62) also includes a floor engagement surface (80) extending on the exterior of right-side portion (66), left-side portion (68), and bottom portion (70). Floor engagement surface (80) is dimensioned to contact the floor while a person utilizes device (10) in accordance with the description herein. As will be described in greater detail below, floor engagement surface (80) is configured to allow a person to utilize their core to roll about their long axis between side plank positions (see FIGS. 14-15) and any other suitable plank position in-between. Further, floor engagement surface (80) is configured to allow a user to either maintain such a suitable plank position in an isometric position, allow the user to rotate between various planking positions in an isotonic dynamic planking fashion, or some combination of isometric and isotonic planking. In some aspects of the disclosure, floor engagement surface (80) is made of a material configured to provide easy sliding of device (10) on ground (G) in the longitudinal direction (A1) (see FIG. 16). Providing easy sliding between floor engagement surface (80) and ground may facilitate various types of exercises that may require movement of device (10) relative to ground (G), such that knee-to-elbow crunches while maintaining a plank position. In some aspects of the disclosure, floor engagement surface (80) may be placed on a suitable sliding mechanism in order to provide a suitable sliding relationship between ground (G) and floor engagement surface (80). Any other suitable means of providing a longitudinally slidable relationship between floor engagement surface (80) and ground (G) may be used as would be apparent to one skilled in the art in view of the teachings herein.

Floor engagement surface (80) includes a longitudinally extending arched profile (82) and a laterally extending arched profile (84). The combination of arched profiles (82, 84) provides for a smooth rotation of device (10) caused by the rotation of the upper body while allowing the feet of the user to suitably support a portion of the body and/or remain substantially stationary as the body maintains a planking position. The combination of arched profiles (82, 84) may also require a user to provide a balancing effort for any suitable planking position during exemplary use of device (10) in accordance with the description herein.

Figure 3:
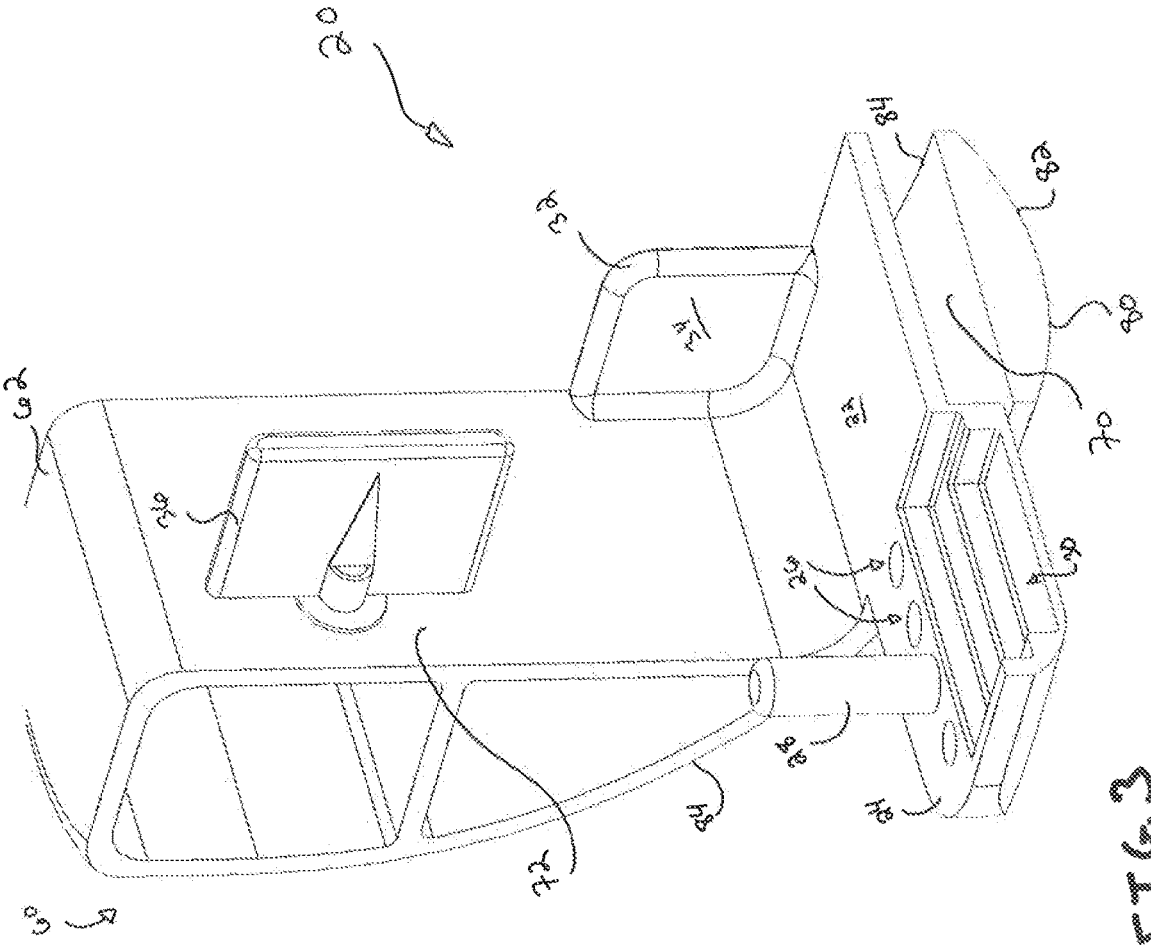
FIG. 3 depicts a sectional view of the core exercise device of FIG. 1, taken along line 3-3 of FIG. 1.
Figure 4:
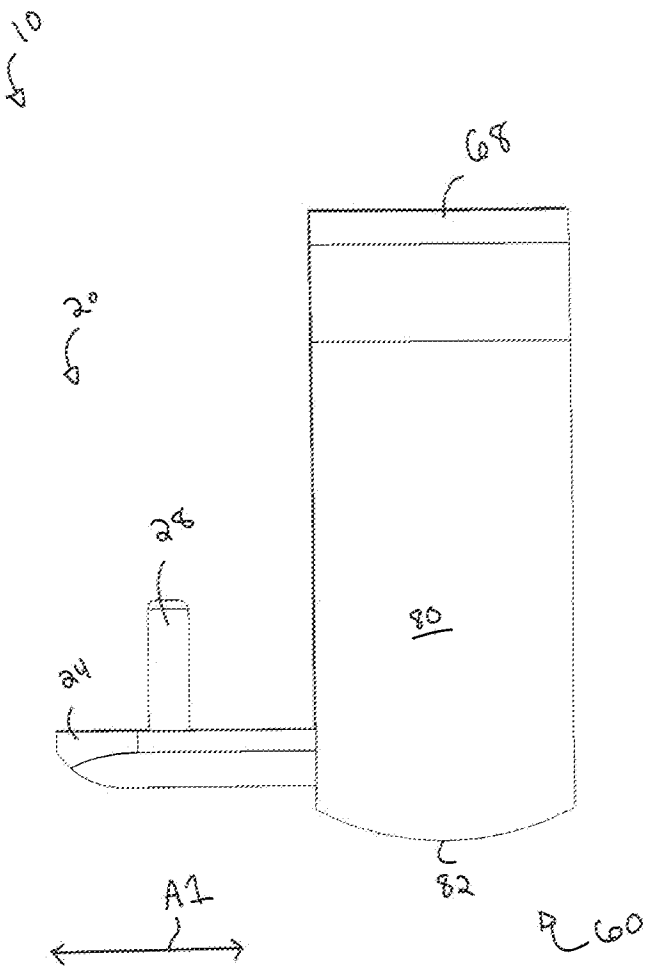
FIG. 4 depicts an elevational side view of the core exercise device of FIG. 1.
Figure 5:
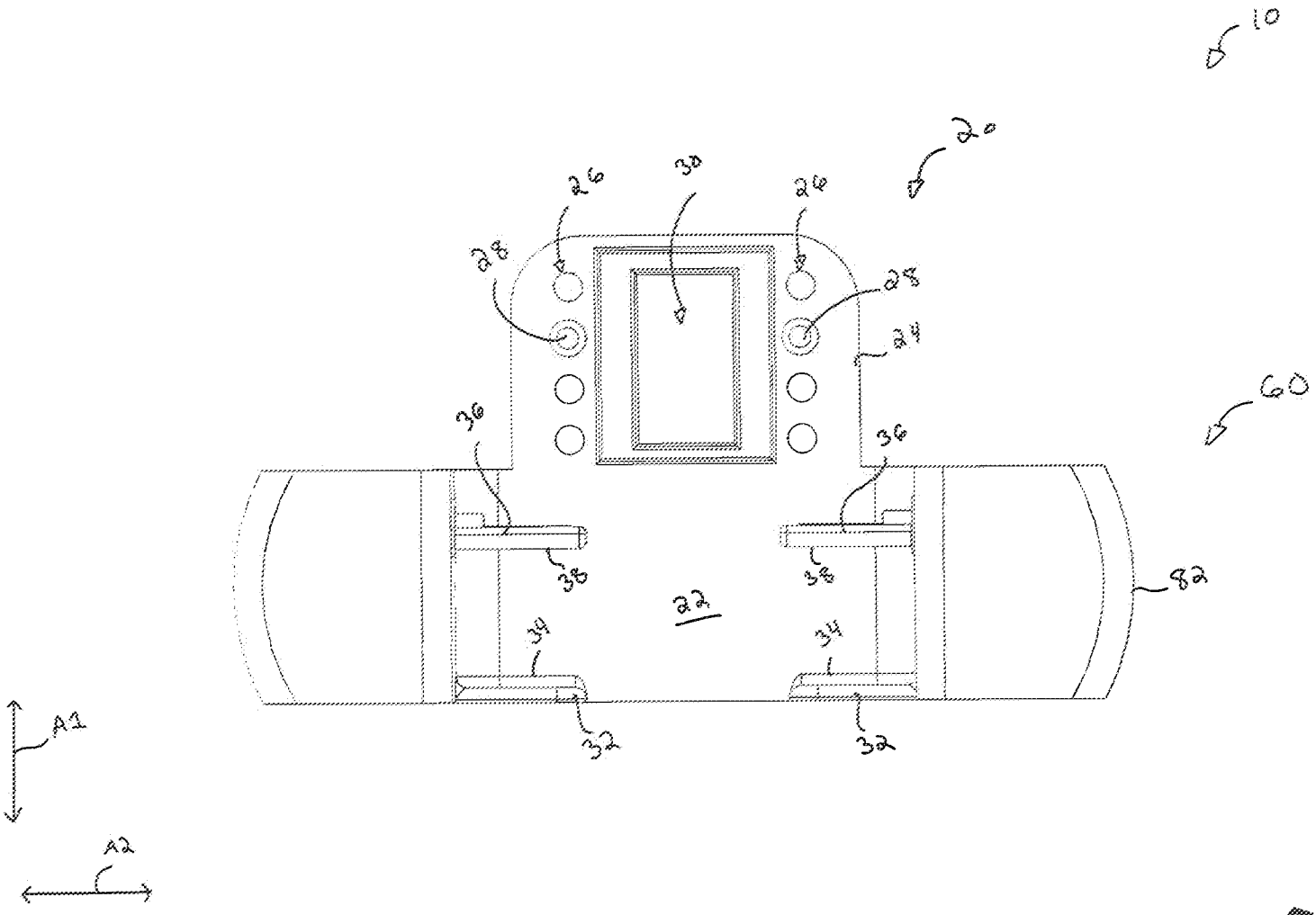
FIG. 5 depicts a top plan view of the core exercise device of FIG. 1.

Longitudinally extending arched profile (82), as best shown in FIGS. 3-4 and 16, allows a user to slightly tilt forward or backwards as indicated by arrow (R) in FIG. 16. Therefore, if a user wants to slightly modify their position relative to the ground (G) by tilting device (10) forward or backward as indicated by arrow (R) in FIG. 16, the portion of floor engagement surface (80) in contact with ground (G) may change along longitudinally extending arched profile (82). Longitudinally extending arched profile (82) is disposed circumferentially on floor engagement surface (80) such that a user may tilt forward or backward as indicated by arrow (R) if user is in the straight plank position (see FIG. 13), either side plank position (see FIGS. 14-15), or any suitable position between side plank positions.

In the current example, as shown in FIG. 16, longitudinally extending arched profile (82) includes an arch extending uninterrupted from a backside of floor engagement body (60) (i.e., the side of body (60) adjacent to elbow pads (32)) all the way to a front side of floor engagement body (60) (i.e., the side of body (60) which forearm support extension (24) extends from). In some aspects of the disclosure, longitudinally extending profile (82) of floor engagement surface (80) may include a profile that does not have an uninterrupted arch extending between the front and back of body (60). For example, a portion of profile (82) may extend linearly in the plane shown in FIG. 16. Such a linear extending portion of profile (82) may be located adjacent the front side and/or back side of body (60), thereby forming a chamfered surface. It should be understood that such a portion extending "linearly" when viewed from the perspective shown in FIG. 16 may still be disposed circumferentially on engagement surface (80) such that the linearly extending portion of profile (82) may suitably engage ground (G) regardless of the planking position a user maintains during exemplary use. Having a portion of profile (82) extend linearly in accordance with the description herein may provide at least some resistance to tilting device during certain exercises, such as exercises that require sliding between floor engagement surface (80) and ground (G). Such a linear extending portion of profile (82) may also be located near the longitudinal center of surface (80) (i.e. the longitudinal portion of surface (80) engaged with the ground in FIG. 16), or any other suitably location as would be apparent to one skilled in the art in view of the teachings herein.

It should be understood that the ground (G) may include any suitable support surface as would be apparent to one skilled in the art in view of the teachings herein. For instance, the ground (G) may include an elevated support surface configured to support floor engagement surface (80); while another surface, either lower or higher relative to ground (G), may support the feet of a user. While in the current example, floor engagement surface (80) is configured to directly engage ground (G) while a user utilizes device (10) to rotate between any suitable plank position as would be apparent to one skilled in the art in view of the teachings herein, this is merely optional. In some aspects of the disclosure, curved body (62) may be dimensioned to fit within a complementary base frame that (A) is interposed between device (10) and ground (G), and (B) suitably houses curved body (62) such that a user may rotate device along a predefined track of the base frame between various plank positions in accordance with the description herein. In such aspects of the disclosure, one or more rollers and/or bearings may be interposed between floor engagement surface (80) and the predefined track of the base frame in order to allow device (10) to rotate relative to the base frame while the base frame remains substantially supported on the ground (G).

Laterally extending arched profile (84), as best shown in FIGS. 1, 6, and 13-15, allows for the user to rotate between both side planks (see FIGS. 14-15). Laterally extending arched profile (84) of floor engagement surface (80) extends between right-side portion (66), bottom portion (70), and left-side portion (68) such that the portion of floor engagement surface (80) in contact with the ground (G) depends on the plank position achieved by the user. Therefore, the user of device (10) may rotate into various plank positions for isotonic exercise by utilizing their core to change the portion of floor engagement surface (80) in contact with the ground (G). A user of device (10) may also hold various plank positions for isometric exercise.

In the current example, as shown in FIGS. 13-15, laterally extending arched profile (84) extends laterally past, and adjacent to, the user's shoulders in the lateral direction (A2) and with a substantially constant or constant radius of curvature. In some instances, floor engagement surface (80) may have a laterally extending arched profile (84) that extends equal to, less than, or greater than a semi-circle. In some instances, laterally extending arched profile (84) may extend such that floor engagement surface (80) forms a full circle. In some instances, curved body (62) may be equal to, narrower, or wider than body engagement portion (20). In some aspects of the disclosure, floor engagement surface (80) may have tactile feedback surfaces strategically placed along laterally extending arched profile (84) in order to provide targeted tactile feedback to the user. Such tactile feedback may be used for any suitable reason(s) as would be apparent to one skilled in the art in view of the teachings herein. In one aspect of the disclosure, tactile feedback surfaces may be located on floor engagement surface (80) at or around ends of right-side portion (66) and left-side portion (68) such that when a user experiences tactile feedback from such surfaces, they are made aware that further rotation may potentially lead to over-rotation of device (10). In an aspect of the disclosure, tactile feedback surfaces may be located on laterally extending arched profile (84) to indicate to a user that predefined plank angles have been achieved, such as a 30-degree angle, a 45-degree angle, a 60-degree angle, or any other suitable plank angle as would be apparent to one skilled in the art in view of the teachings herein. Such tactile feedback surfaces may be designed as to not interfere with full or partial isotonic rotation exercises, yet give the user tactile indication certain plank angles have been achieved. Such tactile feedback surfaces may include flat surface, bumps, ribs, etc. In an aspect of the disclosure, such tactile feedback surfaces may be selectively attachable and movable along floor engagement surface (80) such that a user may customize at what plank angles they receive such tactile feedback.

It should be understood that any suitable radius of curvature may be used for laterally extending arched profile (84) as would be apparent to one skilled in the art in view of the teachings herein. Additionally, the radius of curvature does not necessarily need to be uniform. In some instances, the radius of curvature may deviate along the length of laterally extending arched profile (84) in order to increase/decrease the difficulty of achieving various plank positions. For instance, such changes in the radius of laterally extending arched profile (84) may provide varying stress of isometric exercises and varying degrees of rotational effort for isotonic exercises.

In some instances, it may be desirable to change the radius of curvature for the laterally extending arched profile (84) of floor engagement surface (80). For instance, in a planking position, the more the upper body is elevated relative to the feet, less isometric strain occurs on the core muscles; the less the upper body is elevated relative to the feet, more isometric strain occurs on the core muscles. Therefore, having the ability to change the radius of curvature may allow a user to selectively increase or decrease the difficulty of a workout.

Figure 12:
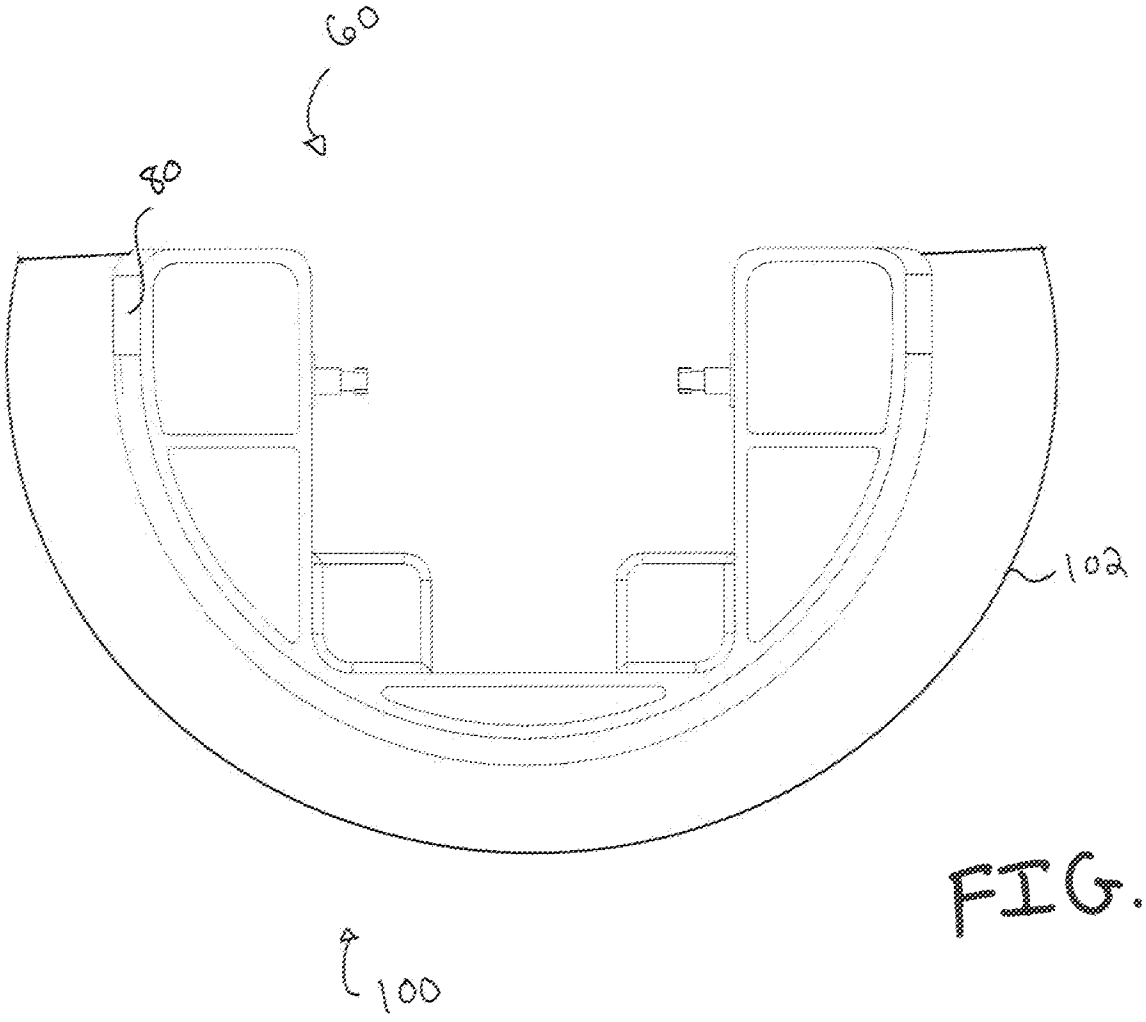
FIG. 12 depicts an elevational front view of the floor engagement portion of FIG. 1 with a radial add-on coupled together.

FIG. 12 shows a radial add-on (100) that may be selectively attached to curved body (62) in order to increase the radius of curvature of floor engagement portion (60). Radial add-on (100) may selectively attach to curved body (62) though any suitable means as would be apparent to one skilled in the art in view of the teachings herein. Radial add-on (100) includes a floor engagement surface (102). Floor engagement surface (102) may be substantially similar to floor engagement surface (80) described above, except that floor engagement surface (102) includes a larger radius of curvature, thereby allowing a user to customize the level of difficulty of their workout. While in the current example, a radial add-on (100) is used to change the radius of curved body (62), any other suitable means may be used to increase/decrease the radius of curved body (62) as would be apparent to one skilled in the art in view of the teachings herein. For instance, mechanical adjustment systems could be provided for variations in the radius of curvature. In some aspects of the disclosure, increased resistance to rotation may be added by attaching weights to right-side portion (66) and/or left-side portion (68), which would increase resistance to rotation toward left-side portion (68) and right-side portion (66), respectively. Additionally or alternately, elastic resistance bands may be attached to side portion (66, 68) and then attached to the ground such that rotation or device (10) between side planks would stretch one resistance band, thereby increasing resistance to achieving a side plank. Additionally or alternatively, increased resistance to rotation can be attached by attaching cable weights to side portion (66, 68).

In some instances, device (10) may include a flexible or elastic attachment(s) between curved body (62) and body engagement portion (20) such that the user is provided with a "springy" feel while using device (10) in accordance with the description herein.

In some instances, device (10) may include selected portions that are inflatable, or be entirely inflatable. Therefore, a user may inflate a device for exemplary use, then deflate the device for easier storage.

II. Exemplary Method of Use of Core Exercise Device

FIGS. 13-16 show an exemplary method of use of core exercise device (10) in order to achieve an isometric plank workout, as well as an isotonic plank workout. First, while optional, a user may customize device (10) for their specific anatomical dimensions in accordance with the description herein. Alternatively, device (10) may come in various sizes, such as small, medium, and large, in order to accommodate users with different anatomical dimensions.

Next, as shown in FIG. 16, a user may suitably engage body engagement portion (20) of core exercise device (10). Specifically, a user may place their upper arms such that their shoulders engage respective shoulder contact surfaces (38) and their elbows engage respective elbow contact surface (34). The user may also rest their forearms on a suitable portion of base surface (22) and forearm support extensions (24) while also grasping grips (28). Upper arms may be supported against respective interior surfaces (72). At this moment, the user has achieved the upper body anatomical positioning associated with a standard plank while also achieving suitable control of device (10) for achieving various planking positions in either isometric or isotonic fashion. In some instances, elbow pads (32) may be optional if firm grasping of grips (28) provides sufficient restriction of elbow movement when elbows are held against interior surface (72).

Next, as shown in FIG. 13, the user may place their feet on the ground (G) such that the only portions of their body touching the ground (G) are their feet, while floor engagement surface (80) is also in contact with the floor. While utilizing their core muscles, the user may achieve a standard plank position as shown in FIG. 13. The user may place their feet wider apart or close together as compared to that shown in FIG. 13.

Since curved body (62) includes floor engagement surface (80) that has a laterally extending arched profile (84) extending to an area of side portions (66, 68) adjacent to the user's shoulder, if the user desires to achieve a side plank position, the user may utilize their core to rotate themselves and device (10) into either side plank position shown in FIGS. 14-15. While in the side plank position, the user may have their upper arm located closest to the ground (G) abutting against the respective interior surface (72) of side portion (66, 68) closest to the ground (G). It should be understood that the user may utilize their core to also rotate themselves to any suitable plank position between the side plank positions shown in FIGS. 14-15. While in the current side planks shown in FIG. 14-15, the user has their feet stacked on top of each other, the user may place their feet wider apart as compared to that shown in FIGS. 14-15 such that both feet maintain suitable contact with the ground (G). In such aspects, while utilizing their core to hold or rotate into the various plank position possible, a user may keep their feet at shoulder width or greater to provide a twisting of the shoulder relative to the hips and legs while performing both isometric and isotonic exercises. This type of positioning of the feet may help a user mimic the core rotation necessary for swinging a golf club, tennis racket, baseball bat, etc., all of which require rotation of the shoulders relative to the hips and legs.

It should be understood that for the many plank positions achievable between the side plank positions shown in FIGS. 14-15, a different portion of floor engagement surface (80) will be in contact with ground (G). Therefore, it should be understood that the user may utilize device (10) in order to rotate themselves as well as floor engagement surface (80) into a virtually infinite number of plank positions between side planks. Having such capabilities may allow a user to exercise selected portions of their core to a greater degree as compared to a strictly standard or side plank.

Further, it should be understood that the user may isometrically hold each plank position for a suitable period of time in order to provide a suitable period of stress for the isometric exercise. Additionally, the user may provide rotational effort about their longitudinal axis in order to perform an isotonic dynamic plank between any two or more suitable planking positions, including side planks. In other words, the user may utilize their core to generate the rotational movement required to controllably transition the portion of floor engagement surface (80) that is in contact with the ground (G), thereby controlling the rotational movement of their own body and device (10) about an axis extending parallel with the long axis of the user's body. This may force the core muscle group to dynamically work through the rotational range of motion. It should be understood that a mix of isometric pauses during isotonic rotation may provide a unique and highly beneficial exercise routine.

As mentioned above, a user may position their feet wider apart, closer together, stacked on top of each other, or any other suitable position as would be apparent to one skilled in the art in view of the teachings herein. In some aspects of the disclosure, additional accessories might include sliders for the feet to move smoothly when spreading the feet apart, moving the feet closer together, or pulling feet closer into a tuck position or pulling the body into a pike position. In some aspects of the disclosure, an accessory may be utilized to elevate the feet during exemplary use of device. In some aspects of the disclosure, a rotation device for the feet may also be incorporated that may allow the feet, while close to each other, to rotate freely in harmony with the body's rotation while using device (10) in accordance with the description herein.

It should be understood that any one or more of the teachings, expressions, embodiments, examples, etc. described herein may be combined with any one or more of the other teachings, expressions, embodiments, examples, etc. that are described herein. The following-described teachings, expressions, embodiments, examples, etc. should therefore not be viewed in isolation relative to each other. Various suitable ways in which the teachings herein may be combined will be readily apparent to those of ordinary skill in the art in view of the teachings herein. Such modifications and variations are intended to be included within the scope of the claims.

Having shown and described various embodiments of the present invention, further adaptations of the methods and systems described herein may be accomplished by appropriate modifications by one of ordinary skill in the art without departing from the scope of the present invention. Several of such potential modifications have been mentioned, and others will be apparent to those skilled in the art. For instance, the examples, embodiments, geometrics, materials, dimensions, ratios, steps, and the like discussed above are illustrative and are not required. Accordingly, the scope of the present invention should be considered in terms of the following claims and is understood not to be limited to the details of structure and operation shown and described in the specification and drawings.

EXEMPLARY COMBINATIONS

The following examples relate to various non-exhaustive ways in which the teachings herein may be combined or applied. It should be understood that the following examples are not intended to restrict the coverage of any claims that may be presented at any time in this application or in subsequent filings of this application. No disclaimer is intended. The following examples are being provided for nothing more than merely illustrative purposes. It is contemplated that the various teachings herein may be arranged and applied in numerous other ways. It is also contemplated that some variations may omit certain features referred to in the below examples. Therefore, none of the aspects or features referred to below should be deemed critical unless otherwise explicitly indicated as such at a later date by the inventors or by a successor in interest to the inventors. If any claims are presented in this application or in subsequent filings related to this application that include additional features beyond those referred to below, those additional features shall not be presumed to have been added for any reason relating to patentability.

Example 1

An exercise device, comprising: (a) a body engagement portion configured to support a user, wherein the body engagement portion comprises a base surface configured to support a user in a standard plank position; and (b) a ground engagement portion comprising an arched contact surface, wherein the arched contact surface is configured to allow a user to rotate between a first side plank position, the standard plank position, and a second side plank position relative to a support surface while the arched contact surface remains in contact with the support surface and the body engagement portion supports the user.

Example 2

The exercise device of any one or more of the preceding Examples, wherein the ground engagement portion comprises a first end and, a bottom portion, and a second end, wherein the first end, the second end, and the bottom portion form a U-shape.

Example 3

The exercise device of any one or more of the preceding Examples, wherein the first end and the second end comprise a first interior surface and a second interior surface, respectively.

Example 4

The exercise device of any one or more of the preceding Examples, wherein the first interior surface and the second interior surface are configured to support a portion of the bodyweight of the user while the user is in the first side plank position and the second side plank position, respectively.

Example 5

The exercise device of any one or more of the preceding Examples, wherein a portion of the body engagement portion extends from the first interior surface and the second interior surface.

Example 6

The exercise device of any one or more of the preceding Examples, wherein the base, the first interior surface, and the second interior surface cooperatively define a U-shaped opening.

Example 7

The exercise device of any one or more of the preceding Examples, wherein the body engagement portion further comprises: (a) a first shoulder pad extending from the first interior surface into the U-shaped opening, and (b) a second shoulder pad extending from the second interior surface into the U-shaped opening.

Example 8

The exercise device of any one or more of the preceding Examples, wherein the body engagement portion further comprises a first elbow pad and a second elbow pad.

Example 9

The exercise device of any one or more of the preceding Examples, wherein the first elbow pad and the second elbow pad extend from the base, the sides, or both the base and sides into the U-shaped opening.

Example 10

The exercise device of any one or more of the preceding Examples, wherein the body engagement portion further comprises a forearm support extending distally from the base surface.

Example 11

The exercise device of any one or more of the preceding Examples, wherein the forearm support is configured to selectively attach to the rest of the body engagement portion.

Example 12

The exercise device of any one or more of the preceding Examples, wherein the body engagement portion further comprises a pair of grips associated with the forearm support.

Example 13

The exercise device of any one or more of the preceding Examples, wherein the pair of grips are configured to selectively adjust into multiple positions on the forearm support.

Example 14

The exercise device of any one or more of the preceding Examples, wherein the arched contact surface comprises a laterally arched profile having a radius of curvature.

Example 15

The exercise device of any one or more of the preceding Examples, wherein the radius of curvature is constant.

Example 16

The exercise device of any one or more of the preceding Examples, wherein the arched contact surface comprises a longitudinally extending arched profile.

Example 17

The exercise device of any one or more of the preceding Examples, wherein the longitudinally extending arched profile extends uninterrupted between a front side of the ground engagement portion and a backside of the ground engagement portion.

Example 18

An exercise device, comprising: (a) a body engagement portion configured to support a user, wherein the body engagement portion comprises: (i) a base surface configured to support a user in a standard plank position, (ii) a pair of shoulder pads, and (iii) a pair of elbow pads longitudinally displaced from the pair of shoulder pads; and (b) a ground engagement portion comprising a laterally arched contact surface, wherein the laterally arched contact surface is configured to allow a user to rotate between a first side plank position, the standard plank position, and a second side plank position while maintaining contact with a support surface.

Example 19

The exercise device of any one or more of the preceding Examples, wherein the ground engagement portion comprises a U-shaped body.

Example 20

An exercise device, comprising: (a) a body engagement portion configured to support a user, wherein the body engagement portion comprises: (i) a base surface configured to support a user in a standard plank position, (ii) a forearm support extending from the base surface, and (iii) a pair of grips associated with the forearm support; and (b) a ground engagement portion configured to allow a user to rotate between a first side plank position, the standard plank position, and a second side plank position relative to a support surface while the ground engagement portion remains in contact with the support surface and the body engagement portion supports the user.

I claim:

1. An exercise device, comprising:

(a) a body engagement portion configured to support a user, wherein the body engagement portion comprises a base surface configured to support the user in a standard plank position; and (b) a ground engagement portion comprising an arched contact surface, wherein the arched contact surface is configured to allow the user to rotate between a first side plank position, the standard plank position, and a second side plank position relative to a support surface while the arched contact surface remains in contact with the support surface and the body engagement portion supports the user.

2. The exercise device of claim 1, wherein the ground engagement portion comprises a first end and, a bottom portion, and a second end, wherein the first end, the second end, and the bottom portion form a U-shape.

3. The exercise device of claim 2, wherein the body engagement portion comprises:

(a) a first interior surface associated with the first end, and (b) a second interior surface associated with the second end.

4. The exercise device of claim 3, wherein the first interior surface and the second interior surface are configured to support a portion of the bodyweight of the user while the user is in the first side plank position and the second side plank position, respectively.

5. The exercise device of claim 4, wherein a portion of the body engagement portion extends from the first interior surface and the second interior surface.

6. The exercise device of claim 4, wherein the base, the first interior surface, and the second interior surface cooperatively define a U-shaped opening.

7. The exercise device of claim 6, wherein the body engagement portion further comprises:

(a) a first shoulder pad extending from the first interior surface into the U-shaped opening, and (b) a second shoulder pad extending from the second interior surface into the U-shaped opening.

8. The exercise device of claim 7, wherein the body engagement portion further comprises a first elbow pad and a second elbow pad.

9. The exercise device of claim 8, wherein the first elbow pad and the second elbow pad extend from the base into the U-shaped opening.

10. The exercise device of claim 1, wherein the body engagement portion further comprises a forearm support extending distally from the base surface.

11. The exercise device of claim 10, wherein the forearm support is configured to selectively attach to the rest of the body engagement portion.

12. The exercise device of claim 10, wherein the body engagement portion further comprises a gripping section associated with the forearm support.

13. The exercise device of claim 12, wherein the gripping section comprises a pair of grips that are configured to selectively adjust into multiple positions on the forearm support.

14. The exercise device of claim 1, wherein the arched contact surface comprises a laterally arched profile having a radius of curvature.

15. The exercise device of claim 14, wherein the radius of curvature is constant.

16. The exercise device of claim 1, wherein the arched contact surface comprises a longitudinally extending arched profile.

17. The exercise device of claim 16, wherein the longitudinally extending arched profile extends uninterrupted between a front side of the ground engagement portion and a backside of the ground engagement portion.

18. An exercise device, comprising:

(a) a body engagement portion configured to support a user, wherein the body engagement portion comprises:

(i) a base surface configured to support a user in a standard plank position, (ii) a pair of shoulder pads, and (iii) a pair of elbow pads longitudinally displaced from the pair of shoulder pads; and (b) a ground engagement portion comprising a laterally arched contact surface, wherein the laterally arched contact surface is configured to allow a user to rotate between a first side plank position, the standard plank position, and a second side plank position while maintaining contact with a support surface.

19. The exercise device of claim 18, wherein the ground engagement portion comprises a U-shaped body.

20. An exercise device, comprising:

(a) a body engagement portion configured to support a user, wherein the body engagement portion comprises:

(i) a base surface configured to support a user in a standard plank position, (ii) a forearm support extending from the base surface, and (iii) a gripping section associated with the forearm support; and (b) a ground engagement portion configured to allow a user to rotate between a first side plank position, the standard plank position, and a second side plank position relative to a support surface while the ground engagement portion remains in contact with the support surface and the body engagement portion supports the user.

* * * * *